US005104765A

United States Patent [19]

Chowdry et al.

[11] Patent Number: 5,104,765

[45] Date of Patent: Apr. 14, 1992

[54] TRANSFER TECHNIQUE FOR SMALL TONER PARTICLES

[75] Inventors: Arun Chowdry, Pittsford; Dennis R. Kamp, Spencerport; Donald S. Rimai, Webster, all of N.Y.

[73] Assignee: Eastman Kodak Company, Rochester, N.Y.

[21] Appl. No.: 489,394

[22] Filed: Mar. 5, 1990

[51] Int. Cl.[5] ..... G03G 13/14
[52] U.S. Cl. ..... 430/126
[58] Field of Search ..... 480/126

[56] References Cited

U.S. PATENT DOCUMENTS 3,955,530 5/1976 Knechtel ..... 430/126 X
4,370,400 1/1983 Cooper et al. ..... 430/126
4,927,727 5/1990 Rimai et al. ..... 430/99

*Primary Examiner*—Marion E. McCamish
*Assistant Examiner*—S. C. Crossan
*Attorney, Agent, or Firm*—Dressler, Goldsmith, Shore, Sutker & Milnomow, Ltd.

[57] ABSTRACT

A process is disclosed for making high resolution copies wherein a toned image is formed on a receiver. First, a uniform coating of clear toner particles is transferred to the surface of a receiver. Next, a latent electrostatic image is developed and transferred to the coated receiver by conventional electrostatic transfer technique.

19 Claims, No Drawings

TRANSFER TECHNIQUE FOR SMALL TONER PARTICLES

FIELD OF THE INVENTION

The invention is in the field of electrostatic toner transfer procedures.

BACKGROUND OF THE INVENTION

In electrostatic copying, an electrostatic latent image is formed on an element. That image can be developed into a visible image by the application of toner powder thereover. The resulting toned image is then transferred from the element to a receiver to which the transferred toned image is fixed, usually by heat fusion. The transfer of the toned image to the receiver has usually heretofore been accomplished electrostatically, using an electrostatic bias applied between the receiver and the element.

In order to produce copies of very high resolution, it is necessary to use toner particles that have a very small particle size, that is, less than about 8 microns.

Electrostatic transfer of such very small toner particles, particularly of those having a particle size less than about 6 microns, is difficult to accomplish because, the forces of adhesion holding the particles to the photoconductor are greater than the electrostatic transfer forces that can be applied. Moreover, Coulombic repulsion between the particles tends to scatter such particles causing loss in transferred image resolution and increase in grain and mottle. To avoid these problems an improved electrostatic transfer process must be used with toned images of such particles.

However, so far as now known, no electrostatic transfer process is known by which a high resolution toner powder image comprised of very small toner particles can be transferred from an element to a receiver that is treated at the time of copying with a preliminary coating produced from toner particles.

SUMMARY OF THE INVENTION

This invention is directed to a process for producing an electrostatically transferred toned image of small toner particles upon a receiver.

The process utilizes a first step of depositing upon a receiver a coating comprised of nonmarking (clear or uncolored) toner particles. The coating is fixed to the receiver surface.

Subsequently, the coated receiver surface is contacted by a imaged surface having thereon a transferrable developed toned image comprised of imaging toner particles. Conventional electrostatic transfer conditions are utilized for this step.

If desired, the nonmarking and imaging toner particles can be admixed with a release agent. The element surface wherein the transferrable toned image is placed can also be coated with a release agent.

The present invention also provides a new and improved class of imaged receivers that have heat fused on one surface thereof a continuous coating of nonmarking toner particles and an overcoated heat fused image comprised of imaging toner particles.

The present invention provides techniques for producing high quality black and white copies or full color copies electrographically on graphic arts paper or other commercially available receiver sheets.

The present invention is advantageous as it permits the transfer of images to be made with toner powders having median volume weighted diameters of less than about 8 microns. It also permits the user to select a wide range of receivers while preserving the look and "feel" of the receiver.

The present invention is adaptable for use with conventional electrostatic copying machines.

The use of nonmarking toner on paper or similar support can assist in the electrostatic transfer of marking toner particles. In this instance the role of the nonmarking toner is to smooth the surface of the receiver. The greatest effect of this technology is observed when the paper has a roughness average (as measured with a Surtronic 3 profilometer) greater than approximately 2 μm. A receiver is prepared by first developing preferably one or less than one monolayer of a nonmarking (clear or uncolored) toner onto a member. The member need not be a photoconductor. Development can be accomplished in any suitable manner including corona charging the member and electrostatically depositing clear toner onto it, pouring the correct amount of toner onto it, etc. Preferable would be the use of a member which consists of or contains an electrically conductive element. This element is grounded. If desired a release agent can be used with the element. Nonmarking toner is deposited on the element using a biased magnetic development brush. The bias is set so that, preferably, the substrate is coated with one, or less than one, monolayer of nonmarking toner particles. The size of the particles is not critical but should have a median volume weighted diameter less than approximately 12 μm but greater than approximately 3 μm. The size can be adjusted so as to allow good transfer to the receiver. Since the coating serves only to smooth the receiver and the toner does not embed into it as it does in thermal assisted transfer, thicknesses of one or less than one monolayer are adequate. Moreover, since intimate contact between the receiver and photoconductor does not occur, and hot separation is not an issue, it is preferably to have the surface energy of the nonmarking toner polymer binder greater than approximately 45 dynes/cm.

The nonmarking toner particles must be transferred from the element to the receiver substrate. To ensure good transfer, it is preferable to use the thermal assisted transfer method, particularly if the mean diameter of the nonmarking particles is less than approximately 8 μm.

The nonmarking toner should be permanently fixed to the receiver prior to the transfer of the marking particles. While this can be done using any suitable technology, the preferred method is by ferrotyping, whereby the receiver bearing the nonmarking particles is cast, under heat and pressure, against a smooth surface. This imparts the smoothness from the ferrotyping surface to the receiver. Transfer of marking particles is then accomplished electrostatically, using a biased roller, corona, or any other suitable method. Subsequently, the image is permanently fixed to the receiver. Transfer can be enhanced using a photoconductor bearing or containing a suitable release agent such as Teflon, zinc stearate, etc. or containing suitable release agents such as, but not limited to various siloxane or fluorine containing polymers. In another embodiment, the nonmarking toner is directly deposited onto the receiver using a magnetic brush, appropriately biased, to develop a layer of nonmarking toner on the support. To ensure proper development it is important that a grounded electrically conductive layer be behind the receiver support during the development. While this can be done by appropriately coating the back of the support, it is preferably to have a metal plate behind the receiver support. Control of the coating thickness to this degree is, however, generally not possible because of the properties of the receiver. Therefore, a greater variation in coating thickness is obtained. Moreover, it is necessary to use higher voltages to ensure adequate nonmarking toner deposition over the entire sheet. This method of producing receiver sheets has the advantages of requiring simple equipment and permitting high process speeds.

DETAILED DESCRIPTION

The term "particle size", as used herein, or the term "size", or "sized" as employed herein in reference to the term "particles", means the mean volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass.

The term "glass transition temperature" or "$T_g$" as used herein means the temperature at which an amorphous material changes from a solid state to a liquid state. This temperature ($T_g$) can be measured by differential thermal analysis as disclosed in N. F. Mott and E. A. Davis, "Electronic Processes in Non-Crystalline Materials," Oxford Press (1971).

The term "melting temperature" or "$T_m$" as used herein means the temperature at which a crystalline material changes from a solid state to a liquid state. This temperature ($T_m$) can be measured by differential thermal analysis as disclosed above.

The term "surface tension" or "surface energy" as used herein means the energy needed to create a unit area of surface from the bulk of a given material. Surface tension or surface energy can be measured by the contact angle procedure disclosed in R. W. Mod. Phys, 57, 827-862 (1985).

The term "element" as used herein has reference to any of the known electrographic elements including photoconductor elements, graphic elements, dielectric recording elements, and like electrographic elements. Examples of such elements can be found in, for instance, U.S. Pat. Nos. 4,175,960 and 3,615,414.

The term "receiver" as used herein refers to a substrate upon which a toner powder image is transferred and subsequently heat fused or otherwise fixed. Examples of suitable receivers include paper, plastic film, such as films of polyethylene terephthalate, polycarbonate, or the like, which are preferably transparent and therefore useful in making transparencies, and the like. The receiver must not melt, soften, or lose mechanical integrity during fixing of toner particles as taught herein although the nonmarking toner can soften or melt. Preferred substrates do not readily absorb the thermoplastic polymer matrix of the nonmarking toner particles when the particles are being heat fused, so that the polymer tends to stay on the surface portions of a substrate and to form a good bond thereto. However, the image bearing toner may migrate into the clear toner layer. Paper is a presently preferred class of receiver. In general, a flexible receiver is particularly desirable.

The nonmarking toner particles employed in the practice of this invention have a particle size in the range of about 3 to about 12 microns, and preferably in the range of about 5 to 9 microns. Such a particle size range is approximately commensurate with, for example, the roughness of preferred paper substrates used as receiver sheets in the practice of the invention, thereby enhancing efficient transferability of the toner particles to the receivers. Smaller sized toner particles are difficult to deposit or transfer while larger toner particles create a thick thermoplastic polymeric layer on the receiver which may present difficulties in transferring an image, adversely affecting image quality or significantly altering the look or feel of the receiver.

The nonmarking toner particles are comprised of a thermoplastic polymer which preferably has a glass transition temperature in the range of about 40° to about 80° C., although thermoplastic polymers which have somewhat higher and lower $T_g$s can be employed, if desired. Preferably such a thermoplastic polymer has a melting temperature ($T_m$) which is in the range of about 80° to about 120° C. although polymers with somewhat higher or lower melting temperatures can be used. Preferably a given group of such particles used in the practice of this invention has a narrow particle size distribution. For example, a size (standard) deviation in the range of about ±3 microns from a mean particle size is presently preferred, although somewhat larger and smaller such deviations can be employed, if desired.

The nonmarking toner particles preferably utilize a polymer which is substantially transparent to visible light. Such particles preferably contain substantially no colorant (i.e., a dye or pigment). However, if desired, a colorant may be incorporated into a group of particles whose color matches, or approximates, the color of a particular receiver with which the nonmarking particles are to be used.

The marking toner particles employed in the practice of the invention have a particle size in the range of about 3 to about 8 microns and are comprised of a thermoplastic polymer which, like the nonmarking toner particles, has a $T_g$ in the range of about 40° to about 80° C. Preferably such a thermoplastic polymer has a melting point or temperature ($T_m$) which is in the range of about 80° to about 120° C., although polymers with somewhat higher or lower melting temperatures can be used. Preferably polymer comprising the binder of the marking particles has an energy tension in the range of about 35 to about 45 dynes per centimeter. The particle size distribution is preferably comparable to the distribution above indicated for the nonmarking particles.

The marking toner particles preferably are compounded with a colorant having the appropriate color for a desired toned image. Black is a preferred color. Multi-colored toned images can be transferred in accordance with this invention. If multi-colored toned images are contemplated, then the marking toner particles need to be compounded with appropriate colorants. Conventional colorants are employed.

The marking toner particles likewise preferably contain a charge agent incorporated thereinto. On a 100 weight percent basis, preferred marking toner particles comprise about 0.05 to about 5 weight percent of charge agent, about 5 to about 20 weight percent of colorant, and the balance thermoplastic polymer. Conventional charge agents can be used.

Both the nonmarking and the marking toner particles can be comprised of polymers such as, for example, amorphous polyesters, styrene butylacrylate copolymers, polystyrene, polyesteramides, and the like.

In both toner particles the polymer employed more preferably has a glass transition temperature or $T_g$ in the range of about 55° to 70° C. Preferably such toner particles also have relatively high caking temperatures, for example, higher than about 55° C., so that the toner powders can be stored for relatively long periods of time at relatively high temperatures with little or no individual particle agglomeration or clumping.

In the practice of the process of this invention, one first uniformly deposits upon a substrate sheet a coating which is comprised of nonmarking toner particles, as above characterized.

In general, a uniform coating of sintered toner particles should cover substantially the entire surface of the substrate. The coating thickness should be approximately equal to or less than a monolayer of the toner particles.

In one embodiment, the nonmarking toner is developed onto a member containing a conducting element. This can be accomplished by using a biased magnetic development brush. The bias is set so that, preferably, the member is coated with one, or less than one, monolayer of nonmarking toner particles. The size of the particles is not critical but the particles should have a median volume weighted diameter less than approximately 12 μm but greater than approximately 4 μm. Since the coating serves only to smooth the receiver and the toner does not embed into it as it does in thermal assisted transfer, thicknesses of one or less than one monolayer are adequate.

The nonmarking toner is then transferred to the receiver and permanently fixed to the receiver prior to the transfer of the marking particles. While this can be done using any suitable technology, the preferred method is by ferrotyping, whereby the receiver bearing the nonmarking particles is cast, under heat and pressure, against a smooth surface. This imparts the smoothness from the ferrotyping surface to the receiver. Transfer of marking particles is then accomplished electrostatically, using a biased roller, corona, or any other suitable method. Subsequently, the image is permanently fixed to the receiver. Transfer can be enhanced using a photoconductor bearing or containing a suitable release agent such as Teflon, zinc stearate, etc. or containing suitable release agents such as, but not limited to various siloxane or fluorine containing polymers.

In another embodiment, the nonmarking toner is directly deposited onto the receiver using a magnetic brush, appropriately biased, to develop a layer of nonmarking toner on the support. To ensure proper development it is important that a grounded electrically conductive layer be behind the receiver support during development. While this can be done by appropriately coating the back of the support, it is preferably to have a metal plate behind the receiver support. Control of the coating thickness to this degree is, however, generally not possible because of the properties of the receiver. Therefore, a greater variation in coating thickness is obtained. Moreover, it is necessary to use higher voltages to ensure adequate nonmarking toner deposition over the entire sheet. This method of producing receiver sheets has the advantages of requiring simple equipment and permitting high process speeds.

The term "release agent" as used herein refers to a substance which, when present at the time when two surfaces are contacted together particularly at elevated temperature, either prevents bonding or sticking from occurring between such surfaces or, if bonding does occur, causes a bond of such a low strength to result that the two surfaces can subsequently be separated without leaving any substantial fragments of one surface embedded in or adhering to the other. Preferred release agents for use in the present invention have a low surface energy which is preferably less than about 40 dynes/centimeter. A release agent should not be chemically reactive with a polymer or developer employed in the practice of this invention or otherwise affect the development process. Examples of suitable release agents for use in this invention include nonpolar compounds, such as hydrophobic metal salts of organic fatty acids, as for instance, zinc stearate, nickel stearate, zinc palmitate, and the like; polysiloxanes including siloxane copolymers, such as poly[4,4'-isopropylidenediphenylene-co-block-poly(dimethylsiloxanediol) sebacate]; and the like; fluorinated hydrocarbons; perfluorinated polyolefins; semi-crystalline polymers, such as certain polyethylenes, polypropylenes, and the like. Polysiloxane release agents are presently preferred.

Such release agents can be applied by various techniques known to the art, such as solvent coating, or rubbing (as when a release agent is being applied as a coating upon an element or the like), mechanical mixing (as when particles are blended with a release agent), or the like.

The process steps of this invention are suitable for a continuous process, such as in a document copying machine, or the like.

A receiver that has been produced in accordance with the process of this invention has on one surface thereof a continuous heat fused coating of nonmarking toner particles that has been overcoated with a heat fused toned image or marking toner particles.

The invention is illustrated by the following examples.

In the examples cited herein, images were developed onto an organic photoconductor using a styrene butylacrylate cyan toner. The toner had a volume weighted diameter of approximately 4.9 μm. The image was transferred to the receiver sheet using a roller, based at −1500 VDC, which also served to press the receiver sheet into contact with the photoconductor. The applied roller nip pressures are in the range of about 0.5 to about 1.5 psig. While transfer could be further improved by using a low adhesion photoconductor or coating the photoconductor with various release aids, as discussed previously, this was not done in the examples presented.

EXAMPLE 1

The image was developed and transferred, as described in the preceding paragraph, to a 20# xerographic bond paper. Transfer efficiency is approximately 60%. The relatively poor efficiency resulted in much mottle in the image.

EXAMPLE 2

This Example is similar to Example 1 except that a layer of nonmarking toner comprised chiefly of styrene butylacrylate and having a diameter of 4.9 μm was first developed onto chrome cermet, that was electrically grounded supported by Estar. The development bias was 200 VDC. The nonmarking toner was transferred to the paper using thermal assisted transfer. Subsequently, the nonmarking toner was permanently fixed by ferrotyping. An image was developed and transferred, using the conditions described in Example 1, to the nonmarking toner bearing paper. Transfer efficiency improved to approximately 85 to 90%. The mottle observed in Example 1 was also significantly improved.

EXAMPLE 3

This Example is similar to Example 1 except that the receiver was a paper produced by Hammermill and sold under the name "Laser Print". The results are similar to those obtained in Example 1.

EXAMPLE 4

This example is similar to Example 2 except that Laser Print paper was used as the receiver. Results are similar to those obtained in Example 7. Transfer efficiency and mottle are much better than that obtained in Example 3.

The invention has been described in detail with particular reference to preferred embodiments thereof, but it will be understood that variations and modifications can be effected within the spirit and scope of the invention.

We claim:

1. A process for producing an electrostatically transferred toned image comprising the steps of:

(a) depositing upon a receiver substrate a uniform coating comprised of nonmarking toner particles;

(b) fixing said coating;

(c) contacting the coated receiver against the surface of an element which has thereon a transferrable toned image comprised of marking toner particles thereby transferring said toned image from said element to said coated receiver; and (d) separating said receiver from said element.

2. The process of claim 1 wherein said receiver is subjected to temperatures sufficient to heat fuse said nonmarking toner particles.

3. The process of claim 1 wherein said receiver is backed by an electrically conductive member.

4. The process of claim 1 wherein said receiver comprises a support layer and an electrically conductive layer bonded thereto.

5. The process of claim 1 wherein said receiver is preliminarily coated with a release agent.

6. The process of claim 1 wherein said nonmarking toner particles are admixed with a release agent.

7. The process of claim 6 wherein said release agent is a polysiloxane.

8. The process of claim 1 wherein the coating that is comprised of said nonmarking toner particles has a thickness in the range of about one or less than one monolayer of said nonmarking toner particles.

9. The process of claim 1 wherein said receiver substrate is paper.

10. A process for producing an electrostatically transferred toned image comprising the steps of:

(a) depositing upon member a uniform coating comprised of nonmarking toner particles;

(b) transferring said nonmarking particles to a receiver support;

(c) affixing said coating on said receiver support;

(d) contacting the coated receiver against the surface of an element which has thereon a transferrable toned image comprised of marking toner particles thereby transferring said toned image from said element to said coated receiver; and (e) separating said receiver from said element.

11. The process of claim 10 wherein said nonmarking particles are transferred by thermal assisted transfer.

12. The process of claim 10 wherein said nonmarking particles are transferred by electrostatic transfer.

13. The process of claim 10 wherein said receiver is subjected to temperatures sufficient to heat fuse said nonmarking toner particles.

14. The process of claim 10 wherein said member comprises a support layer and an electrically conductive layer bonded thereto.

15. The process of claim 10 wherein said element is preliminarily coated with a release agent.

16. The process of claim 10 wherein said nonmarking toner particles are admixed with a release agent.

17. The process of claim 16 wherein said release agent is a polysiloxane.

18. The process of claim 10 wherein the coating that is comprised of said nonmarking toner particles has a thickness in the range of about one or less than one monolayer of said nonmarking toner particles.

19. The process of claim 10 wherein said receiver support is paper.

* * * * *